US011231183B2

(12) United States Patent
Yan et al.

(10) Patent No.: US 11,231,183 B2
(45) Date of Patent: Jan. 25, 2022

(54) AIR TREATMENT DEVICE AND AIR CONDITIONER INDOOR UNIT HAVING THE SAME

(71) Applicant: GD MIDEA AIR-CONDITIONING EQUIPMENT CO., LTD., Guangdong (CN)

(72) Inventors: Changlin Yan, Guangdong (CN); Liangrui Chen, Guangdong (CN); Hongliang Yuan, Guangdong (CN); Zhiqiang Liu, Guangdong (CN); Xianyou Mao, Guangdong (CN); Daijie Peng, Guangdong (CN); Zhiqiang Yang, Guangdong (CN); Liang Shen, Guangdong (CN)

(73) Assignee: GD MIDEA AIR-CONDITIONING EQUIPMENT CO., LTD., Guangdong (CN)

( * ) Notice: Subject to any disclaimer, the term of this patent is extended or adjusted under 35 U.S.C. 154(b) by 269 days.

(21) Appl. No.: 16/497,080

(22) PCT Filed: Jun. 25, 2018

(86) PCT No.: PCT/CN2018/092676
§ 371 (c)(1),
(2) Date: Sep. 24, 2019

(87) PCT Pub. No.: WO2019/169791
PCT Pub. Date: Sep. 12, 2019

(65) Prior Publication Data

US 2020/0149750 A1 May 14, 2020

(30) Foreign Application Priority Data

Mar. 7, 2018 (CN) ..... 201810187161.4
Mar. 7, 2018 (CN) ..... 201820317372.0

(51) Int. Cl.
*F24F 1/0073* (2019.01)
*F24F 8/10* (2021.01)
*F24F 8/117* (2021.01)

(52) U.S. Cl.
CPC ..... *F24F 1/0073* (2019.02); *F24F 8/10* (2021.01); *F24F 8/117* (2021.01)

(58) Field of Classification Search
CPC ..... F24F 1/0073; F24F 8/117; F24F 1/0071; F24F 11/89; F24F 2221/32; F24F 13/20
(Continued)

(56) References Cited

U.S. PATENT DOCUMENTS

2015/0308732 A1* 10/2015 Lee ..... F24F 3/14 62/291

FOREIGN PATENT DOCUMENTS

CN 101625142 A 1/2010
CN 203704223 U 7/2014
(Continued)

OTHER PUBLICATIONS

Supplementary Search Report dated Apr. 7, 2020 received in European Patent Application No. EP 18909076.4.
(Continued)

*Primary Examiner* — Steve S Tanenbaum
(74) *Attorney, Agent, or Firm* — Scully Scott Murphy & Presser

(57) ABSTRACT

An air treatment device and an air conditioner indoor unit are provided. The air treatment device has an air outlet frame of a purification air duct. The air outlet frame has a ventilation hole and a cooperation hole. A water tank drawer is moveable on the air outlet frame and has two spaced-apart cooperation protrusions on a bottom wall thereof. A safety locking member of the air treatment device has a rotating shaft and a locking member. The rotating shaft is rotatable
(Continued)

in the cooperation hole to switch the locking member between a locking position of the locking member and a movement-permitting position of the locking member. At the locking position, the locking member engages the cooperation protrusions to prevent the displacement of the cooperation protrusions. At the movement-permitting position, the locking member is located between the two cooperation protrusions to avoid engagement with the cooperation protrusions.

10 Claims, 8 Drawing Sheets

(58) Field of Classification Search
USPC ..... 62/259.1
See application file for complete search history.

(56) References Cited

FOREIGN PATENT DOCUMENTS

| | | | |
|---|---|---|---|
| CN | 203940564 | U | 11/2014 |
| CN | 104848445 | A | 8/2015 |
| CN | 204830346 | U | 12/2015 |
| CN | 206739560 | U | 12/2017 |
| EP | 2 966 378 | A1 | 1/2016 |
| JP | H11-83073 | A | 3/1999 |
| JP | 2000-104988 | A | 4/2000 |
| JP | 2010-270770 | A | 12/2010 |
| JP | 2012-152742 | A | 8/2012 |
| KR | 1992-0008342 | Y1 | 11/1992 |
| KR | 10-2009-0126371 | A | 12/2009 |

OTHER PUBLICATIONS

International Search Report dated Nov. 21, 2018 issued in PCT/CN2018/092676.

Notice of Reasons for Refusal dated Nov. 4, 2020 received in Japanese Patent Application No. JP 2019-552527 together with an English language translation.

Notification of Reason for Refusal dated Oct. 23, 2020 received in Korean Patent Application No. KR 10-2019-7029782 together with an English language translation.

* cited by examiner

AIR TREATMENT DEVICE AND AIR CONDITIONER INDOOR UNIT HAVING THE SAME

CROSS-REFERENCE TO RELATED APPLICATIONS

The subject application is a national stage entry of PCT International Application No. PCT/CN2018/092676, filed on Jun. 25, 2018, which claims priority to Chinese Patent Application No. 201810187161.4, filed on Mar. 7, 2018, and Chinese Patent Application No. 201820317372.0, filed on Mar. 7, 2018. The entire disclosure of each of PCT International Application No. PCT/CN2018/092676, Chinese Patent Application No. 201810187161.4 and Chinese Patent Application No. 201820317372.0 is incorporated by reference for all purposes. No new matter has been introduced.

FIELD

The present disclosure relates to the technical field of household appliances, and in particular, to an air treatment device and an air conditioner indoor unit having the same.

BACKGROUND

With the development of economy in China, the excessive growth of urban population and the acceleration of urbanization progress, air pollution problems, such as haze and the like, have become a focus of widespread concern, and users have put forward further requirements for the air treatment function of air conditioners.

An air conditioner indoor unit is purified by setting multiple layers of filter screens, a solid adsorbent, electronic dust removal and the like, and its working mode is to block and filter by using the filter screens and to adsorb liquid or solid particles in the polluted air via electron adsorption and the solid adsorbent. In such a dust removal mode, the dust particles are blocked on the filter screens, a collector or the adsorbent. However, the dust particles block a part of air from entering the air conditioner indoor unit, thereby reducing the air intake amount, and accordingly, the working efficiency of the air conditioner indoor unit is reduced. Moreover, the filter screens and the adsorbent need to be cleaned or replaced frequently, some dust particles and harmful bacteria are attached to the filter screens, a refrigerator, a grating and an air door, which are difficult to be cleaned and likely to cause secondary air pollution.

SUMMARY

The present disclosure aims at solving at least one of the technical problems existing in the prior art. To this end, the present disclosure proposes an air treatment device that has the advantages of high operational safety.

The present disclosure further provides an air conditioner indoor unit having the air treatment device described above.

The air treatment device according to an embodiment of the present disclosure includes: an air outlet frame of a purification air duct, wherein the air outlet frame is provided with a ventilation hole and a cooperation hole; a water tank drawer, wherein the water tank drawer is moveable on the air outlet frame of a purification air duct, and two spaced-apart cooperation protrusions are arranged on a bottom wall of the water tank drawer; and a safety locking member, wherein the safety locking member includes a rotating shaft and a locking member, the rotating shaft is rotatable in the cooperation hole to switch the locking member between a locking position of the locking member and a movement-permitting position of the locking member. At the locking position, the locking member engages the cooperation protrusions to prevent the displacement of the cooperation protrusions. At the movement-permitting position, the locking member is located between the two cooperation protrusions to avoid engagement with the cooperation protrusions, such that the displacement of the cooperation protrusions is allowed.

In the air treatment device according to the embodiment of the present disclosure, by providing the safety locking member, a cooperation relationship between the locking member and the two cooperation protrusions on the water tank drawer can be changed by rotating the rotating shaft, so that the cooperation relationship between the water tank drawer and the air outlet frame of a purification air duct can be switched, that is, the water tank drawer can be pulled out from the air outlet frame of a purification air duct, and the water tank drawer can also be defined on the air outlet frame of a purification air duct, so as to prevent a child from accidentally pushing and pulling the water tank drawer to cause an accident, so that the operational safety of the air treatment device can be improved.

According to some embodiments of the present disclosure, the air outlet frame of a purification air duct is provided with a cooperation groove, the cooperation hole is formed in the bottom wall of the cooperation groove, and the rotating shaft is arranged in the cooperation groove and is rotatable in the cooperation hole.

According to some examples of the present disclosure, the safety locking member includes a cooperation cover, the cooperation cover is rotatably located in the cooperation groove, a first curved surface is arranged on an outer peripheral wall of the cooperation cover, a second curved surface cooperating with the first curved surface is arranged on an inner peripheral wall of the cooperation cover, the rotating shaft is arranged on the cooperation cover, and the locking member is arranged on a top wall of the cooperation cover.

In some embodiments of the present disclosure, two intersecting planes are arranged on the outer peripheral wall of the cooperation cover, and the two ends of the first curved surface are respectively connected with the two intersecting planes.

In some embodiments of the disclosure, the safety locking member further includes a handle projection, and the handle projection is arranged at an intersection of the two intersecting planes.

In some embodiments of the present disclosure, the air treatment device further includes a hollow supporting column, the supporting column is arranged around the cooperation hole, the cooperation cover is covered and supported on the supporting column, and the rotating shaft passes through the supporting column to cooperate with the cooperation hole.

In some examples of the present disclosure, a plurality of spaced apart positioning grooves are formed in the inner peripheral wall of the cooperation groove, a plurality of elastic protrusions are arranged on the outer peripheral wall of the cooperation cover, and at least one of the elastic protrusions cooperates with one of the positioning grooves at the movement-permitting position and the locking position.

In some embodiments of the present disclosure, a notch extending to the bottom wall of the cooperation cover is formed in the outer peripheral wall of the cooperation cover, and a plurality of the notches are formed in both sides of each of the elastic protrusions.

According to some embodiments of the present disclosure, a dismounting port communicating with the cooperation hole is formed in the air outlet frame, an abutting projection is arranged at a lower end of the rotating shaft, the abutting projection and the dismounting port are arranged to be staggered to each other at the locking position and the movement-permitting position, and when the rotating shaft is rotated until the abutting projection is aligned with the dismounting port, the rotating shaft can be separated from the air outlet frame.

The air conditioner indoor unit according to an embodiment of the present disclosure includes the air treatment device described above.

In the air conditioner indoor unit of the embodiment of the present disclosure, by providing the safety locking member, the relative position between the locking member and the two cooperation protrusions on the water tank drawer can be changed by rotating the rotating shaft, so that the positional relationship between the water tank drawer and the air outlet frame of a purification air duct can be switched, that is, the water tank drawer can be pulled out from the air outlet frame of a purification air duct, and the water tank drawer can also be defined on the air outlet frame of a purification air duct, so as to prevent the child from accidentally pushing and pulling the water tank drawer to cause an accident, so that the operational safety of the air treatment device can be improved.

Additional aspects and advantages of the present disclosure are partially set forth in the description below, and a part will become obvious from the description below, or is understood from the practice of the present disclosure.

BRIEF DESCRIPTION OF THE DRAWINGS

The above and/or additional aspects and advantages of the present disclosure will become apparent and readily understood from the description of the embodiments herein in combination with drawings, wherein.

Figure 1:
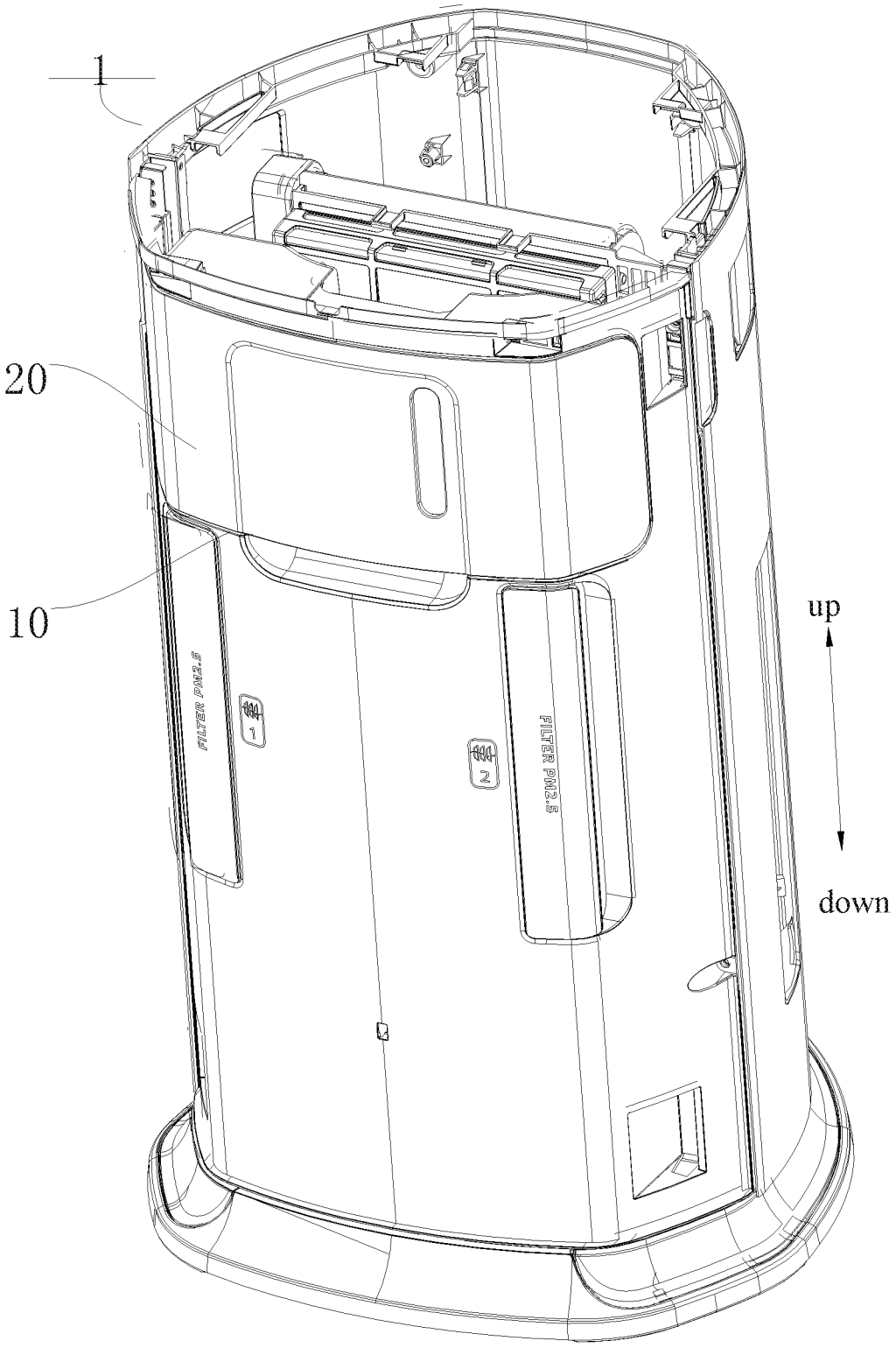
FIG. 1 is a structural schematic diagram of an air treatment device according to an embodiment of the present disclosure.
Figure 2:
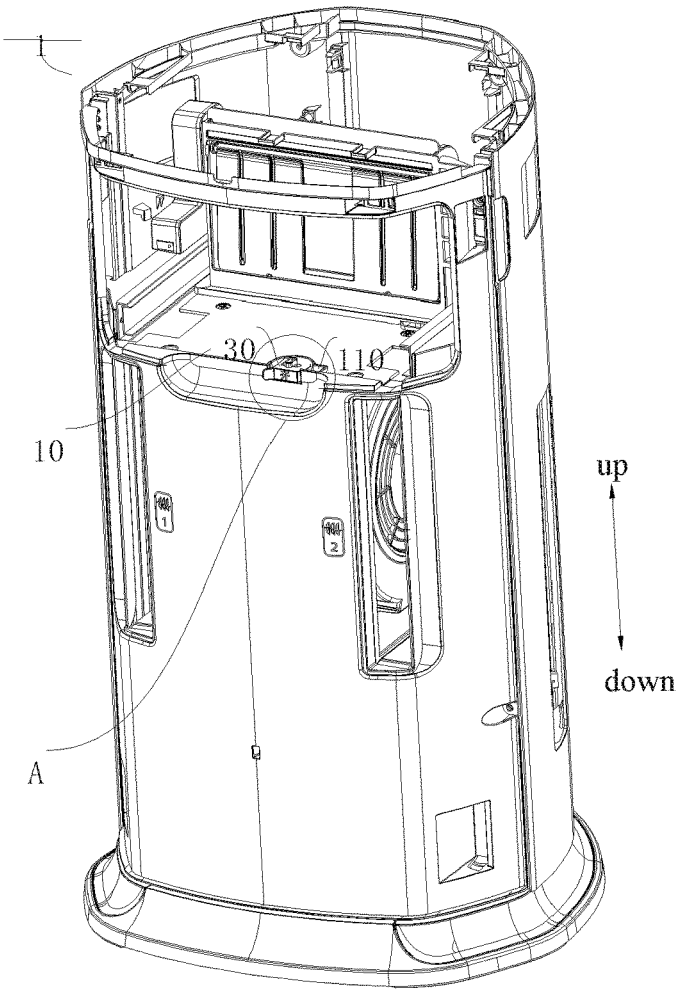
FIG. 2 is a schematic diagram of a local structure of an air treatment device according to an embodiment of the present disclosure.
Figure 3:
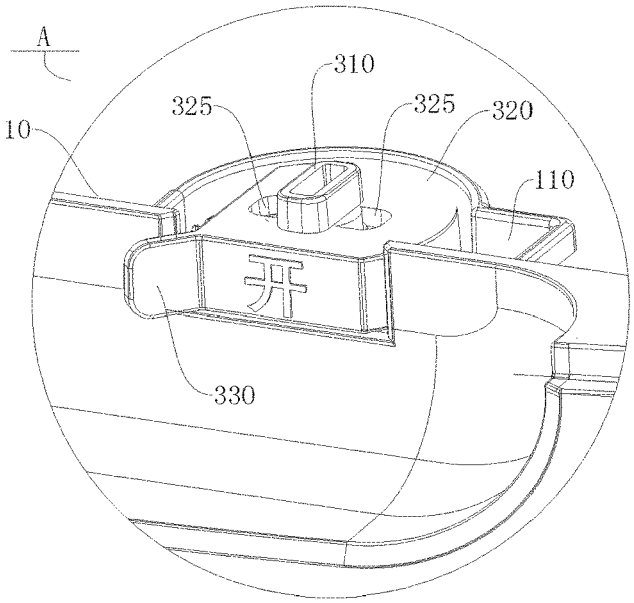
FIG. 3 is a structural enlarged view of a site A in FIG. 2.

Reference signs: air treatment device 1, air outlet frame 10 of a purification air duct, cooperation hole 100, cooperation groove 110, opening 1111, positioning groove 113, second curved surface 114, supporting column 120, dismounting port 130, water tank drawer 20, cooperation protrusion 200, first guide inclined plane 211, second guide inclined plane 212, safety locking member 30, rotating shaft 300, abutting projection 301, locking member 310, handle projection 330, cooperation cover 320, first curved surface 321, plane 322, elastic protrusion 323, notch 324, groove body 325.

DETAILED DESCRIPTION OF THE EMBODIMENTS

The embodiments of the present disclosure are described in detail below, examples of the embodiments are illustrated in the drawings, wherein the same or similar reference signs represent the same or similar elements or elements having the same or similar functions all the time. The embodiments described below with reference to the drawings are exemplary, are only used for explaining the present disclosure, but cannot be construed as limitations to the present disclosure.

In the description of the present disclosure, it should be understood that orientation or position relationships indicated by terms such as "center", "longitudinal", "transverse", "length", "width", "thickness", "upper", "lower", "front", "back", "left", "right", "top", "bottom", "inner", "outer", "axial", "radial", "circumferential" and the like are orientation or position relationships shown in the drawings, are merely for the convenience of describing the present disclosure and simplifying the description, rather than indicating or implying that devices or components referred to must have specific orientations and must be constructed and operated in specific orientations, and therefore cannot be understood as limitations to the present disclosure. In addition, features defining "first" and "second" can include one or more of the features either explicitly or implicitly. In the description of the present disclosure, "a plurality" means two or more, unless otherwise stated.

In the description of the present disclosure, it should be noted that the terms "installation", "connected" and "connection" should be understood broadly, unless otherwise explicitly stipulated and defined, for example, can be a fixed connection, a detachable connection or an integrated connection; can be a mechanical connection and can also be an electric connection; and can be a direct direction, can also be an indirect connection through an intermediate medium, and can be the internal communication of two elements. For those of ordinary skill in the art, the specific meanings of the above terms in the present disclosure can be understood in specific situations.

As shown in FIG. 1 to FIG. 14, an air treatment device 1 according to an embodiment of the present disclosure includes an air outlet frame 10 of a purification air duct, a water tank drawer 20, and a safety locking member 30.

Specifically, as shown in FIG. 1 to FIG. 14, the air outlet frame 10 of a purification air duct is provided with a cooperation hole 100 and a ventilation hole and, and the water tank drawer 20 is arranged on the air outlet frame 10 of the purification air duct in a push-pull manner. Two spaced-apart cooperation protrusions 200 are arranged on a bottom wall of the water tank drawer 20. The safety locking member includes a rotating shaft 300 and a locking member 310. The locking member 310 is arranged at the top of the rotating shaft 300. The rotating shaft 300 is rotatably arranged in the cooperation hole 100 between a locking position and a movement-permitting position. The locking member 310 is located on the front sides of the cooperation protrusions 200 to prevent the displacement of the cooperation protrusions 200 at the locking position. The locking member 310 is located between the two cooperation protrusions 200 at the movement-permitting position.

It can be understood that, as shown in FIG. 1 to FIG. 7 and FIG. 12 to FIG. 14, the air outlet frame 10 of the purification air duct is provided with the cooperation hole 100 and the ventilation hole. The ventilation hole is used for enabling the airflow to pass through, and the cooperation hole 100 is used for assembling the safety locking member 30. The water tank drawer 20 can be placed on an upper surface (for example, the upper surface as shown in FIG. 1, FIG. 2, FIG. 4 and FIG. 12 to FIG. 13) of the air outlet frame 10 of a purification air duct. Furthermore, the water tank drawer 20 is moveable relative to the air outlet frame 10 of a purification air duct. A relative positional relationship between the water tank drawer 20 and the air outlet frame 10 can be changed by pushing or pulling the water tank drawer 20.

Figure 5:
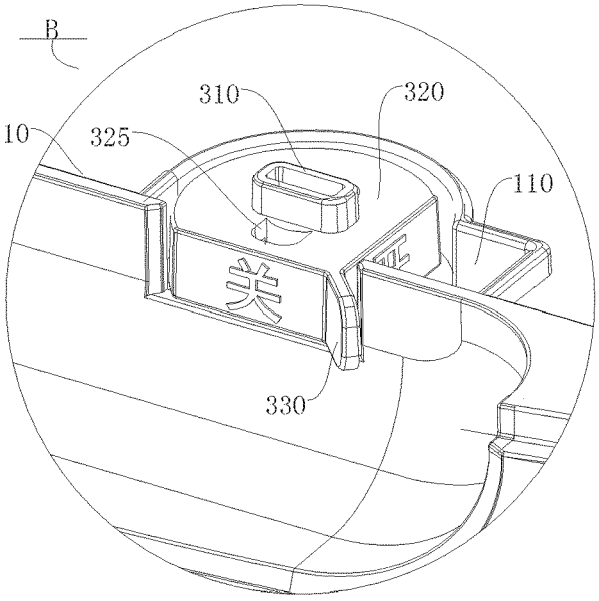
FIG. 5 is a structural enlarged view of a site B in FIG. 4.
Figure 6:
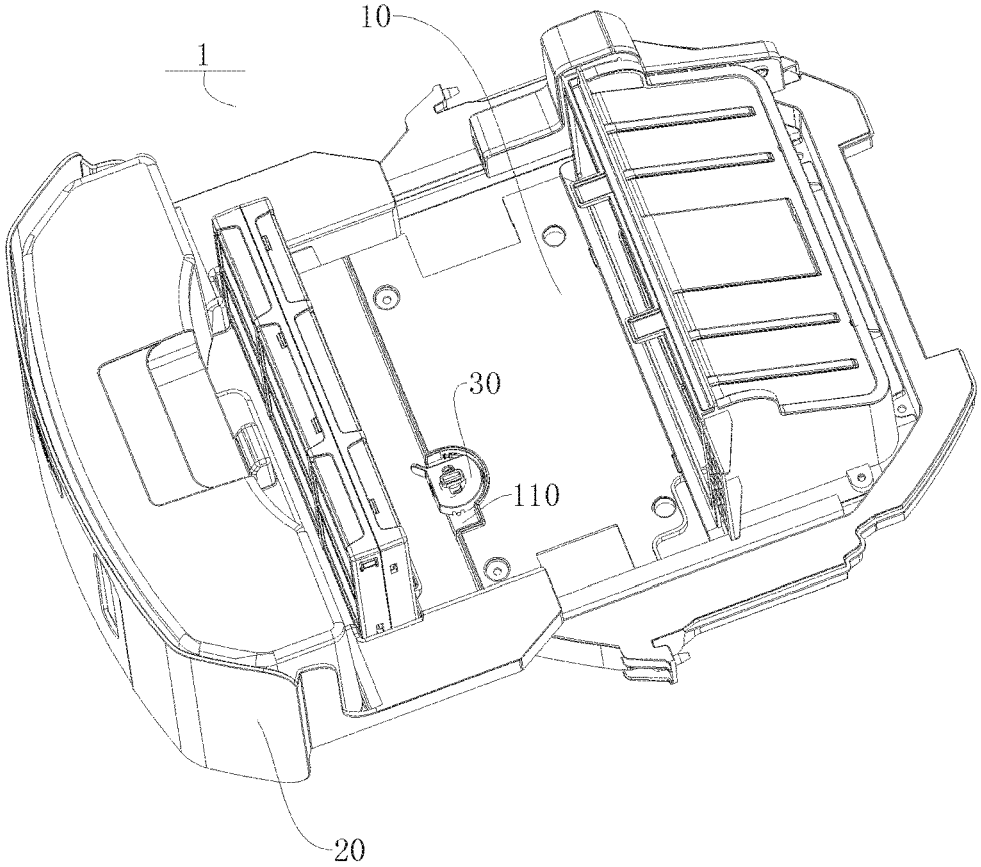
FIG. 6 is a schematic diagram of a local structure of an air treatment device according to an embodiment of the present disclosure.
Figure 7:
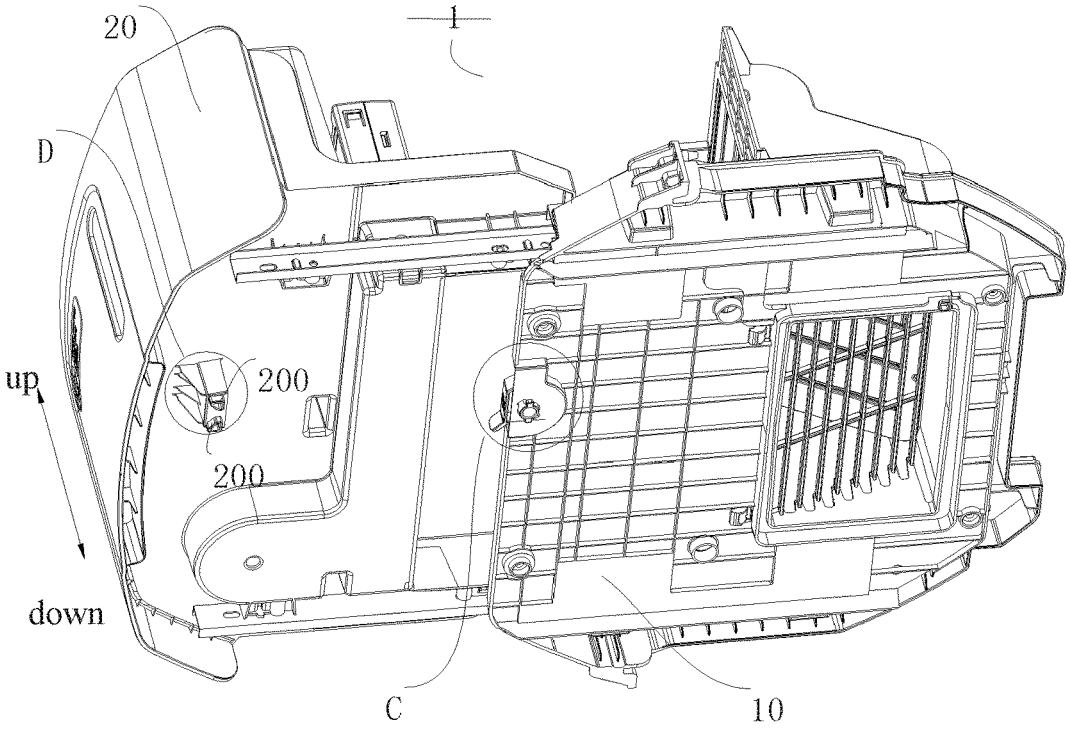
FIG. 7 is a schematic diagram of a local structure of an air treatment device according to an embodiment of the present disclosure.
Figure 9:
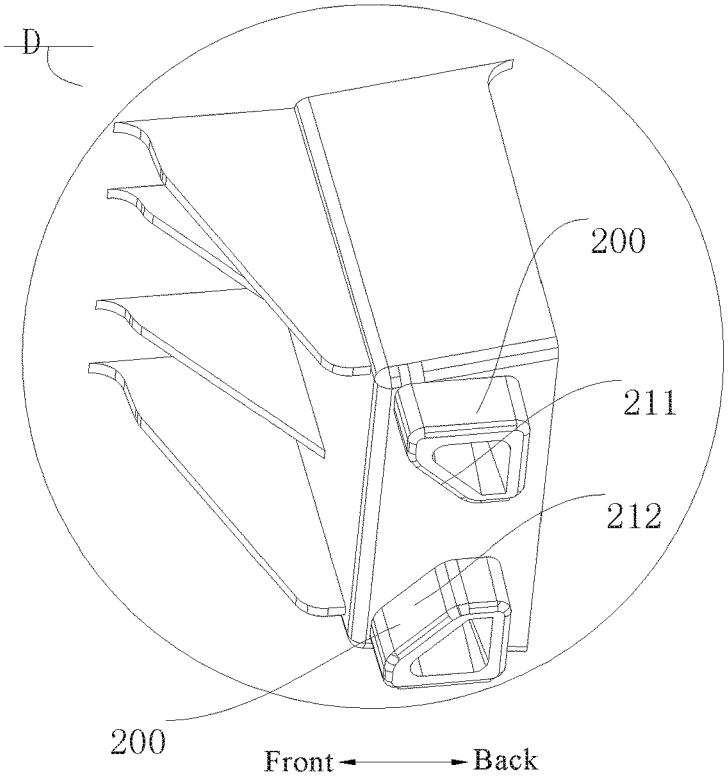
FIG. 9 is a structural enlarged view of a site D in FIG. 7.

As shown in FIG. 1 to FIG. 7 and FIG. 11, the safety locking member 30 can include a rotating shaft 300 and a locking member 310. One end of the locking member 310 is connected to the rotating shaft 300, and the other end of the rotating shaft 300 can pass through the cooperation hole 100. The rotating shaft 300 is rotatable in the cooperation hole 100. The locking member 310 is located outside of the cooperation hole 100 and is located on one side of the air outlet frame 10 adjacent to the water tank drawer 20. In other words, the locking member 310 is located at the upper side of the air outlet frame 10 of a purification air duct. As shown in FIG. 9, two cooperation protrusions 200 are arranged on a lower surface (the lower surface as shown in FIG. 7 and FIG. 12) of the water tank drawer 20, and the two cooperation protrusions 200 are space from each other by a gap.

Figure 10:
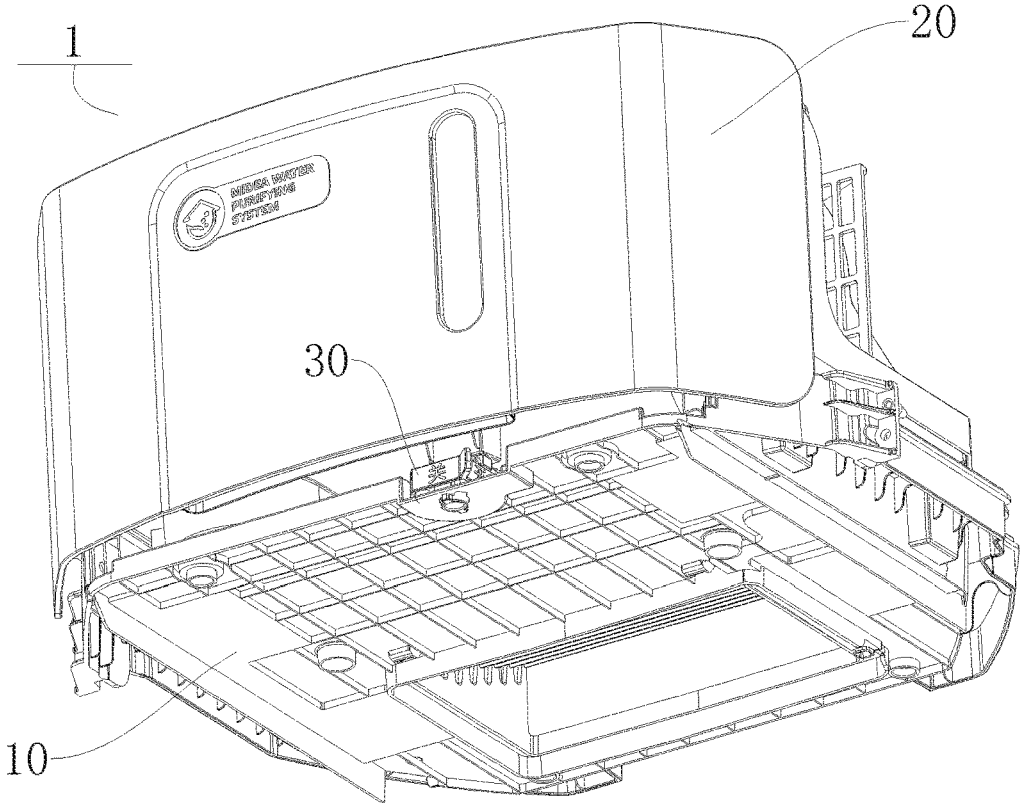
FIG. 10 is a schematic diagram of a local structure of an air treatment device according to an embodiment of the present disclosure.
Figure 12:
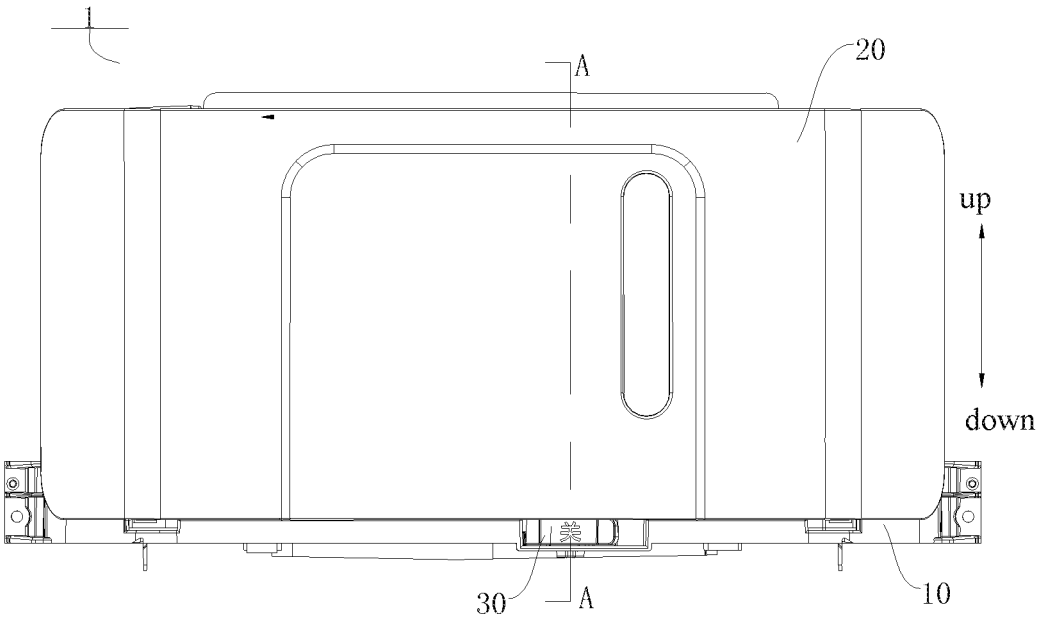
FIG. 12 is a schematic diagram of a local structure of an air treatment device according to an embodiment of the present disclosure.

As shown in FIGS. 1, 10 and 12, when the water tank drawer 20 is located on the air outlet frame 10 (that is, the water tank drawer 20 is stacked on the air outlet frame 10, and the lower surface (the lower surface as shown in FIGS. 1, 10 and 12) of the water tank drawer 20 is opposite to the upper surface (the upper surface as shown in FIGS. 1, 10 and 12) of the air outlet frame 10), the safety locking member 30 can cooperate with the two cooperation protrusions 200 on the lower surface (the lower surface as shown in FIGS. 7 and 12) of the water tank drawer 20, so as to lock the water tank drawer 20 on the air outlet frame 10 or to unlock the water tank drawer 20 from the air outlet frame 10.

It should be noted that, "the water tank drawer 20 is locked on the air outlet frame 10 of a purification air duct" mentioned herein can indicate that the water tank drawer 20 is defined on the air outlet frame 10 of the purification air duct, that is, the water tank drawer 20 is static relative to the air outlet frame 10 of a purification air duct. "The water tank drawer 20 is unlocked from the air outlet frame 10 of a purification air duct" mentioned herein can indicate that the water tank drawer 20 is movable relative to the air outlet frame 10 of the purification air duct and that the water tank drawer 20 can be pulled to space the lower surface (the lower surface as shown in FIGS. 1, 10 and 12) of the water tank drawer 20 apart from the upper surface (the upper surface as shown in FIGS. 1, 10 and 12) of the air outlet frame 10. FIGS. 6 and 7 are views showing when the water tank drawer 20 is pulled out from the air outlet frame 10 of a purification air duct.

Figure 4:
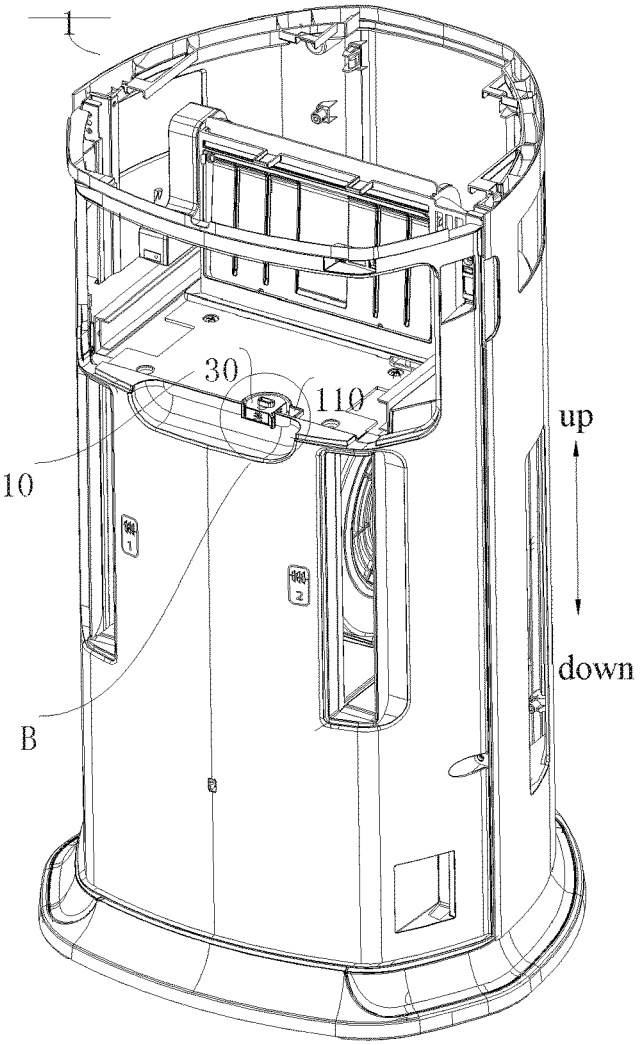
FIG. 4 is a schematic diagram of a local structure of an air treatment device according to an embodiment of the present disclosure.

When the rotating shaft 300 is rotated to the locking position (that is, the position where the rotating shaft 300 is located in FIG. 4 to FIG. 5, the locking member 310 is located on the front sides (the front sides as shown in FIG. 9) of the two cooperation protrusions 200, and the length of the locking member 310 in the arrangement direction of the two cooperation protrusions 200 is greater than the gap between the two cooperation protrusions 200), the locking member 310 cannot pass through the space between the two cooperation protrusions 200. In other words, the water tank drawer 20 cannot be pulled out from the air outlet frame 10, so that the water tank drawer 20 can be confined on the air outlet frame 10 of a purification air duct. When the rotating shaft 300 is rotated to the movement-permitting position (that is, the position where the rotating shaft 300 is located in FIG. 2 to FIG. 3, the locking member 310 is located between the two cooperation protrusions 200, and the length of the locking member 310 in the arrangement direction of the two cooperation protrusions 200 is less than the gap between the two cooperation protrusions 200), the locking member 310 can pass through the space between the two cooperation protrusions 200. In other words, the water tank drawer 20 can be pulled out from the air outlet frame 10, and the water tank drawer 20 is movable relative to the air outlet frame 10.

In the air treatment device 1 according to the embodiment of the present disclosure, by providing the safety locking member 30, the relative position between the locking member 310 and the two cooperation protrusions 200 on the water tank drawer 20 can be switched by rotating the rotating shaft 300. In other words, the water tank drawer 20 can be pulled out from the air outlet frame 10, and the water tank drawer 20 can also be confined on the air outlet frame 10, which can, for example, prevent a child from accidentally pushing and pulling the water tank drawer 20 to cause an accident. As a result, the safety of operating the air treatment device 1 can be improved.

Figure 8:
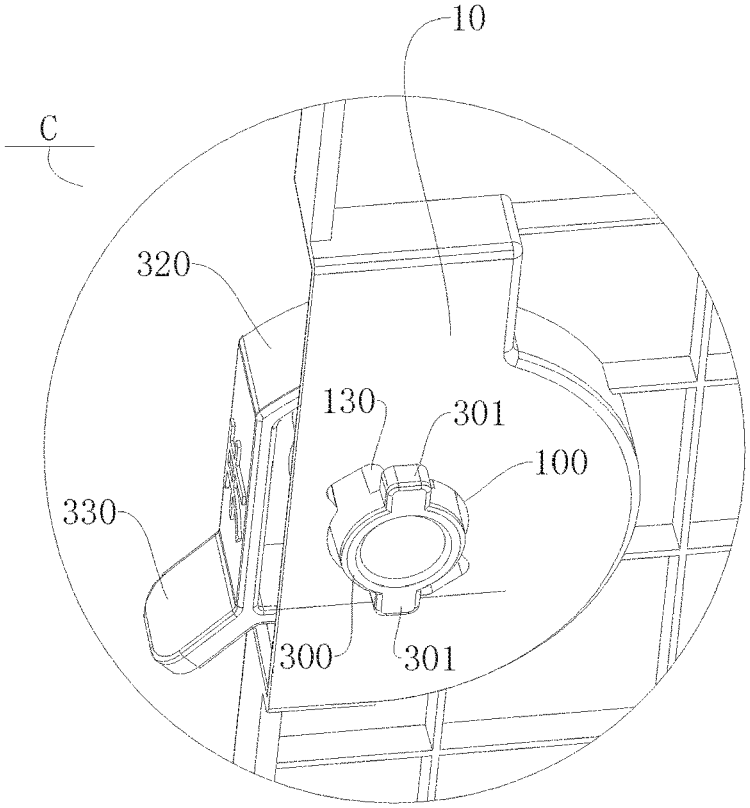
FIG. 8 is a structural enlarged view of a site C in FIG. 7.

As shown in FIG. 8, according to some embodiments of the present disclosure, the rotating shaft 300 can be a hollow member, so that the weight of the rotating shaft 300 can be reduced. Accordingly, the production cost of the safety locking member 30 can be reduced, and the safety locking member 30 can also be conveniently operated and installed. As shown in FIG. 9, according to some embodiments of the present disclosure, one cooperation protrusion 200 includes a first guide inclined plane 211 and the other cooperation protrusion 200 includes a second guide inclined plane 212. The first guide inclined plane 211 and the second guide inclined plane 212 are opposite to each other. In a direction in which the water tank drawer 20 operationally approaches the air outlet frame 10 of the purification air duct, the distance between the first guide inclined plane 211 and the second guide inclined plane 212 is gradually reduced. Thus, the first guide inclined plane 211 and the second guide inclined plane 212 collectively provide a space, in which the locking member 310 can be rotated for conveniently switching the position of the rotating shaft 300.

Figure 11:
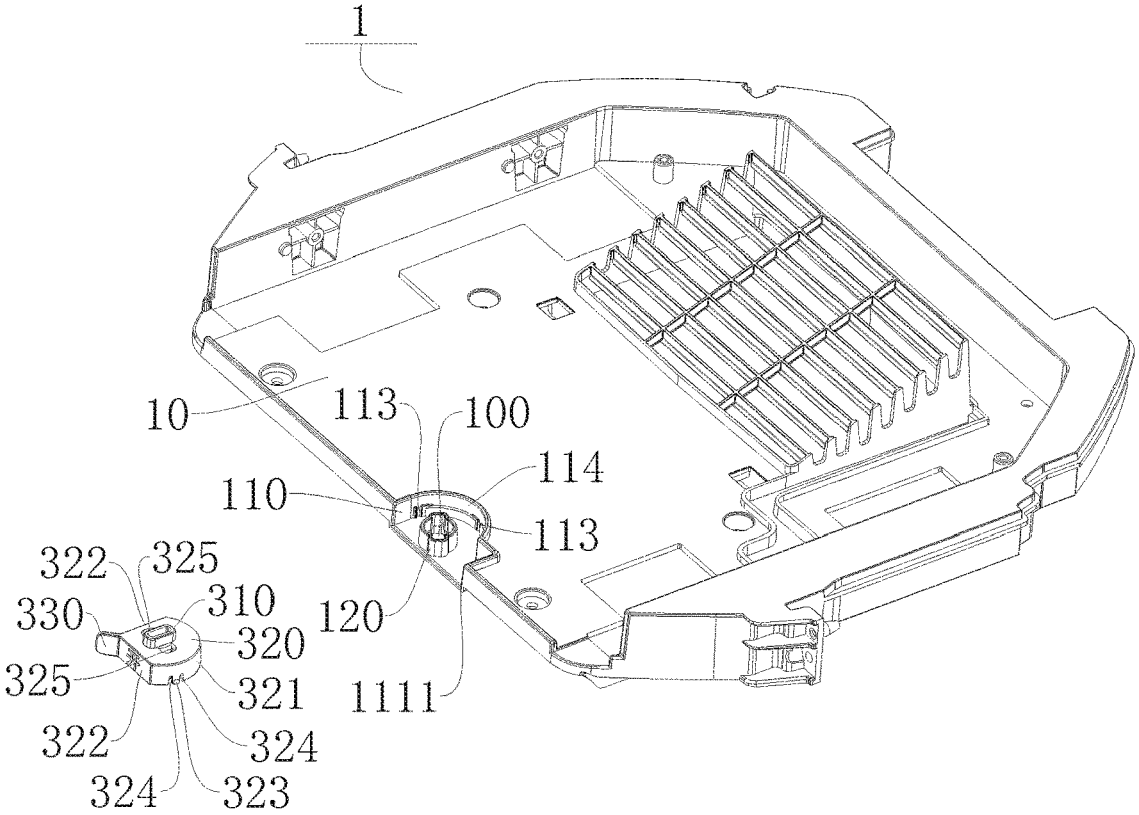
FIG. 11 is a schematic diagram of a local structure of an air treatment device according to an embodiment of the present disclosure.

As shown in FIG. 11, according to some embodiments of the present disclosure, the air outlet frame 10 of the purification air duct can be provided with a cooperation groove 110. The cooperation hole 100 is formed in the bottom wall of the cooperation groove 110. The rotating shaft 300 is arranged in the cooperation groove 110 and rotatable within the cooperation hole 100. It can be understood that the upper surface (the upper surface as shown in FIGS. 1, 10 and 12) of the air outlet frame 10 can be provided with the cooperation groove 110, the cooperation hole 100 is located in the cooperation groove 110, and the cooperation hole 100 passes through the bottom wall of the cooperation groove 110. Therefore, the cooperation groove 110 can provide a movement space for the rotating shaft 300, thereby facilitating the rotation of the rotating shaft 300 to complete the switching of the position of the rotating shaft 300.

In some embodiments of the present disclosure, as shown in FIG. 11, the top of the cooperation groove 110 is open, in other words, the cooperation groove 110 includes an inner peripheral wall and a bottom wall, the inner peripheral wall is located on the bottom wall (on the bottom wall as shown in FIG. 1, FIG. 10 and FIG. 12), and the inner peripheral wall is connected with the bottom wall. Thereby, the rotating shaft 300 can pass through the cooperation hole 100 from the open end of the cooperation groove 110, so that the safety locking member 30 can be assembled in the cooperation groove 110, thereby facilitating the installation of the safety locking member 30. In some embodiments of the present disclosure, as shown in FIG. 11, the inner peripheral wall can be provided with an opening 1111, and the opening 1111 penetrates through the inner peripheral wall. Thereby, the rotating shaft 300 can be operated through the opening 1111.

As shown in FIG. 2 to FIG. 6 and FIG. 11, according to some examples of the present disclosure, the safety locking member 30 can include a cooperation cover 320. The cooperation cover 320 is rotatably located in the cooperation groove 110. The cooperation cover 320 has a first curved surface 321 arranged on an outer peripheral wall of the cooperation cover 320. A second curved surface 114, cooperating with the first curved surface 321, is arranged on the inner peripheral wall of the cooperation groove 110. The rotating shaft 300 is arranged on the cooperation cover 320, and the locking member 310 is arranged on a top wall of the cooperation cover 320.

It can be understood that, the safety locking member 30 can further include the cooperation cover 320, the cooperation cover 320 is connected with the rotating shaft 300 (for example, the cooperation cover 320 can be sleeved on the rotating shaft 300), the locking member 310 is connected with the top wall of the cooperation cover 320, the rotating shaft 300 can be rotated by rotating the cooperation cover 320, and thus the relative positions between the locking member 310 and the two cooperation protrusions 200 can be switched.

The cooperation cover 320 can be embedded in the cooperation groove 110, the outer peripheral wall of the cooperation cover 320 includes the first curved surface 321. Accordingly, the inner peripheral wall of the cooperation groove 110 includes the second curved surface 114. The second curved surface 114 matches with the first curved surface 321. For example, the curvature of the first curved surface 321 can be the same as or supplemental to the curvature of the second curved surface 114, and the center of curvature of the first curved surface 321 can coincide with the center of curvature of the second curved surface 114. Thus, in a process of rotating the rotating shaft 300, the first curved surface 321 can be rotated along the second curved surface 114, so that the rotation smoothness of the cooperation cover 320 can be improved, and the size of the cooperation groove 110 can also be reduced.

As shown in FIG. 11, in some embodiments of the present disclosure, two intersecting planes 322 are arranged on the outer peripheral wall of the cooperation cover 320, and the two ends of the first curved surface 321 are respectively connected with the two planes 322. It can be understood that the outer peripheral wall of the cooperation cover 320 can include the first curved surface 321 and the two intersecting planes 322, and that the first curved surface 321 and the two intersecting planes 322 can be connected at heads and tails to form a fan shape. Thus, the size of the cooperation cover 320 can be reduced, and the user can also judge the position of the rotating shaft 300 by the viewing the position of the intersection between the two intersecting planes with respect to the cooperation groove 110.

In some embodiments of the present disclosure, as shown in FIGS. 6, 8 and 11, the safety locking member 30 further includes a handle projection 330, and the handle projection 330 is arranged at the intersection of the two intersecting planes 322. Thus, the user can pivot the handle projection 330 to rotate the cooperation cover 320 so as to switch the position of the rotating shaft 300. For example, as shown in FIGS. 6, 8 and 11, the handle projection 330 can be a bar-shaped member. One end of the handle projection 330 is connected to the intersection of the two intersecting planes 322 on the cooperation cover 320. The other end of the handle projection 330 is away from the cooperation cover 320 and extends from the opening 1111 of the cooperation groove 110 to facilitate the operation of the user. By setting the handle projection 330 as the bar-shaped member, the user can conveniently hold the same.

As shown in FIG. 11, in some embodiments of the present disclosure, a plurality of grooves 325 can be arranged in the top wall of the cooperation cover 320. The plurality of grooves 325 can be arranged around the locking member 310, and the groove bodies 325 can depress toward the interior of the cooperation cover 320. Thus, the molding of the cooperation groove 110 can be conveniently implemented by using the grooves 325. For example, two grooves 325 can be arranged on the top wall of the cooperation cover 320, and the two grooves 325 are located on the both sides of the locking member 310. Thus, two fingers can be inserted into the two grooves 325 to hold the cooperation cover 320 so as to conveniently operate the cooperation cover 320, for example, during assembly and disassembly and the like.

As shown in FIG. 11, in some embodiments of the present disclosure, the air treatment device 1 can further include a supporting column 120 that is hollow, the supporting column 120 is arranged around the cooperation hole 100, the cooperation cover 320 is covered and supported on the supporting column 120, and the rotating shaft 300 passes through the supporting column 120 to cooperate with the cooperation hole 100. It can be understood that the supporting column 120 can be formed in a cylindrical shape, the supporting column 120 can extend along the circumferential direction of the cooperation hole 100, the cooperation hole 100 is located in the inner cylinder of the supporting column 120, the cooperation cover 320 can be covered on the supporting column 120, the supporting column 120 can support the cooperation cover 320, and the rotating shaft 300 is inserted in the cooperation cover 320.

Therefore, the supporting column 120 can be used for supporting the cooperation cover 320, so that the mounting stability of the cooperation cover 320 can be improved, scratches on the bottom wall of the cooperation groove 110 caused by the cooperation cover 320 in the rotation process are avoided, and the rotation smoothness of the cooperation cover 320 can also be improved. The supporting column 120 can also limit the rotation of the rotating shaft 300, improve the rotation stability of the rotating shaft 300, and prevent the rotating shaft 300 from swaying left and right in the rotation process.

As shown in FIG. 11, in some embodiments of the present disclosure, a plurality of spaced-apart positioning grooves 113 are formed in the inner peripheral wall of the cooperation groove 110, a plurality of elastic protrusions 323 are arranged on the outer peripheral wall of the cooperation cover 320, and at least one of the elastic protrusions 323 cooperates with one of the positioning grooves 113 at the movement-permitting position and the locking position. Therefore, the maneuverability of the safety locking member 30 can be improved. When the rotating shaft 300 of the safety locking member 30 is located at any one of the locking position and the movement-permitting position, a sensible feedback can be provided to the operator through the cooperation relationship between the elastic protrusions 323 and the positioning grooves 113 to inform the operator to stop the rotation, so that the operation experience of the safety locking member 30 can be improved.

When the rotating shaft 300 is at the movement-permitting position, at least one elastic protrusion 323 can be fitted into the positioning groove 113; and when the cooperation cover 320 is rotated to cause the rotating shaft 300 to switch from the movement-permitting position to the locking position, the elastic protrusion 323 can be removed from the corresponding positioning groove 113. In the process of continuously rotating the cooperation cover 320 to switch the rotating shaft 300 to the locking position, at least one elastic protrusion 323 can slide into one of the plurality of positioning grooves 113, and the elastic protrusion 323 cooperates with the positioning groove 113. When the elastic protrusion 323 slides into the positioning groove 113 and subsequently slides out of the positioning groove 113, the operation becomes difficult and the user needs to increase the rotation force, so that the position information of the rotating shaft 300 can be fed back to the user. As a result, whether the rotating shaft 300 is located at the locking position or movement-permitting position can also be fed back to the user.

In some embodiments of the present disclosure, as shown in FIG. 11, the joint of the positioning groove 113 and the cooperation groove 110 can be a smooth curved surface. Thus, the elastic protrusion 323 can conveniently slide into the positioning groove 113, and the elastic protrusion 323 can also conveniently slide out of the positioning groove 113. In some embodiments of the present disclosure, a notch 324, extending to the bottom wall of the cooperation cover 320, is formed in the outer peripheral wall of the cooperation cover 320. The notches 324 are formed in both sides of each of the elastic protrusions 323. It can be understood that a plurality of notches 324 are formed in the outer peripheral wall of the cooperation cover 320, each of the elastic protrusions 323 corresponds to two notches 324, the two notches 324 are located on the both sides of the elastic protrusion 323, and each notch 324 extends toward the top wall of the cooperation cover 320. Thus, the elastic protrusion 323 can be conveniently fitted into the positioning groove 113, and the elastic protrusion 323 can also conveniently slide out of the positioning groove 113. It should be noted that the "bottom wall of the cooperation cover 320" mentioned herein may refer to a bottom surface of the cooperation cover 320, that is, an inner surface of the top wall of the cooperation cover 320.

As shown in FIG. 8 and FIG. 10, according to some embodiments of the present disclosure, a dismounting port 130 communicating with the cooperation hole 100 is formed in the air outlet frame 10 of the purification air duct. An abutting projection 301 is arranged at a lower end of the rotating shaft 300. The abutting projection 301 and the dismounting port 130 are arranged to be staggered or offset to each other at the locking position and the movement-permitting position. When the rotating shaft 300 is rotated until the abutting projection 301 is aligned with the dismounting port 130, the rotating shaft 300 can be separated from the air outlet frame 10 of the purification air duct. It can be understood that the dismounting port 130 is formed in the air outlet frame 10 of the purification air duct, the dismounting port 130 passes through the air outlet frame 10 of the purification air duct, the dismounting port 130 communicates with the cooperation hole 100, and one end of the rotating shaft 300 away from the end of the locking member 310 is provided with the abutting projection 301.

In the process of assembling the rotating shaft 300 to the air outlet frame 10 of the purification air duct, the abutting projection 301 needs to be aligned with the dismounting port 130. In the process when the dismounting port 130 passes through the cooperation hole 100, the abutting projection 301 can pass through the dismounting port 130. The rotating shaft 300 is subsequently rotated, until the abutting projection 301 is staggered to the dismounting port 130 and the abutting projection 301 abuts against the lower surface (the lower surface as shown in FIG. 7) of the air outlet frame 10 of a purification air duct. Thus, as shown in FIG. 7 to FIG. 8, the rotating shaft 300 can be confined on the air outlet frame 10 of the purification air duct. When the rotating shaft 300 is switched between the locking position and the movement-permitting position, the abutting projection 301 remains staggered relative to the dismounting port 130.

In some embodiments of the present disclosure, as shown in FIG. 8 and FIG. 10, a plurality of dismounting ports 130 can be provided. The plurality of dismounting ports 130 can be arranged along the circumferential direction of the cooperation hole 100. A plurality of abutting projections 301 can be arranged at the lower end of the rotating shaft 300, and the plurality of abutting projections 301 are in one-to-one correspondence with a plurality of cooperation holes 100. Thus, the plurality of cooperation holes 100 can position the plurality of abutting projections 301, respectively. For example, two dismounting ports 130 can be provided, and the two dismounting ports 130 are located at both ends of the cooperation hole 100 in the radial direction.

An air conditioner indoor unit according to an embodiment of the present disclosure includes the air treatment device 1 described above.

In the air conditioner indoor unit of the embodiment of the present disclosure, by disposing the safety locking member 30, the relative position between the locking member 310 and the two cooperation protrusions 200 on the water tank drawer 200 can be changed by rotating the rotating shaft 300, so that the positional relationship between the water tank drawer 20 and the air outlet frame 10 of the purification air duct can be switched. In other words, the water tank drawer 20 can be pulled out from the air outlet frame 10 of the purification air duct, and the water tank drawer 20 can also be limited on the air outlet frame 10, so as to prevent a child from accidentally pushing and pulling the water tank drawer 20 to cause an accident, so that the operational safety of the air treatment device 1 can be improved.

The air treatment device 1 according to the present disclosure will be described in detail below with reference to FIG. 1 to FIG. 14. It is worthy of being understood that the following description is only illustrative and is not a specific limitation to the present disclosure.

As shown in FIG. 1 to FIG. 14, the air treatment device 1 includes an air outlet frame 10 of a purification air duct, a water tank drawer 20, and a safety locking member 30. The air outlet frame 10 of the purification air duct is provided with a cooperation hole 100, a cooperation groove 110, a supporting column 120 and a ventilation hole. The ventilation hole is used for enabling the airflow to pass through. The cooperation groove 110, the supporting column 120 and the cooperation hole 100 are used for assembling the safety locking member 30. The cooperation groove 110 includes an inner peripheral wall and a bottom wall, the inner peripheral wall is located on the bottom wall (on the bottom wall as shown in FIGS. 1, 10 and 12), and the inner peripheral wall is connected with the bottom wall. The inner peripheral wall is provided with an opening 1111, and the opening 1111 extends through the inner peripheral wall. The cooperation hole 100 is formed in the bottom wall of the cooperation groove 110. The supporting column 120 is located in the cooperation groove 110, and the supporting column 120 is arranged around the cooperation hole 100.

Figure 13:
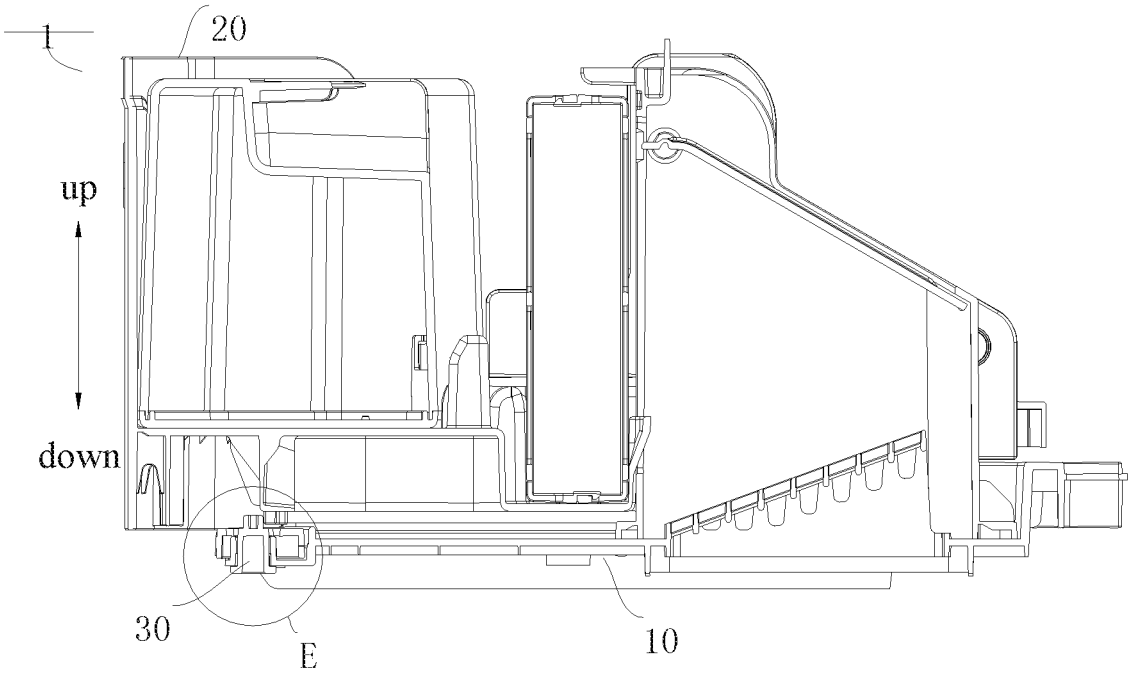
FIG. 13 is a schematic diagram of a sectional structure of a site A-A in FIG. 12.
Figure 14:
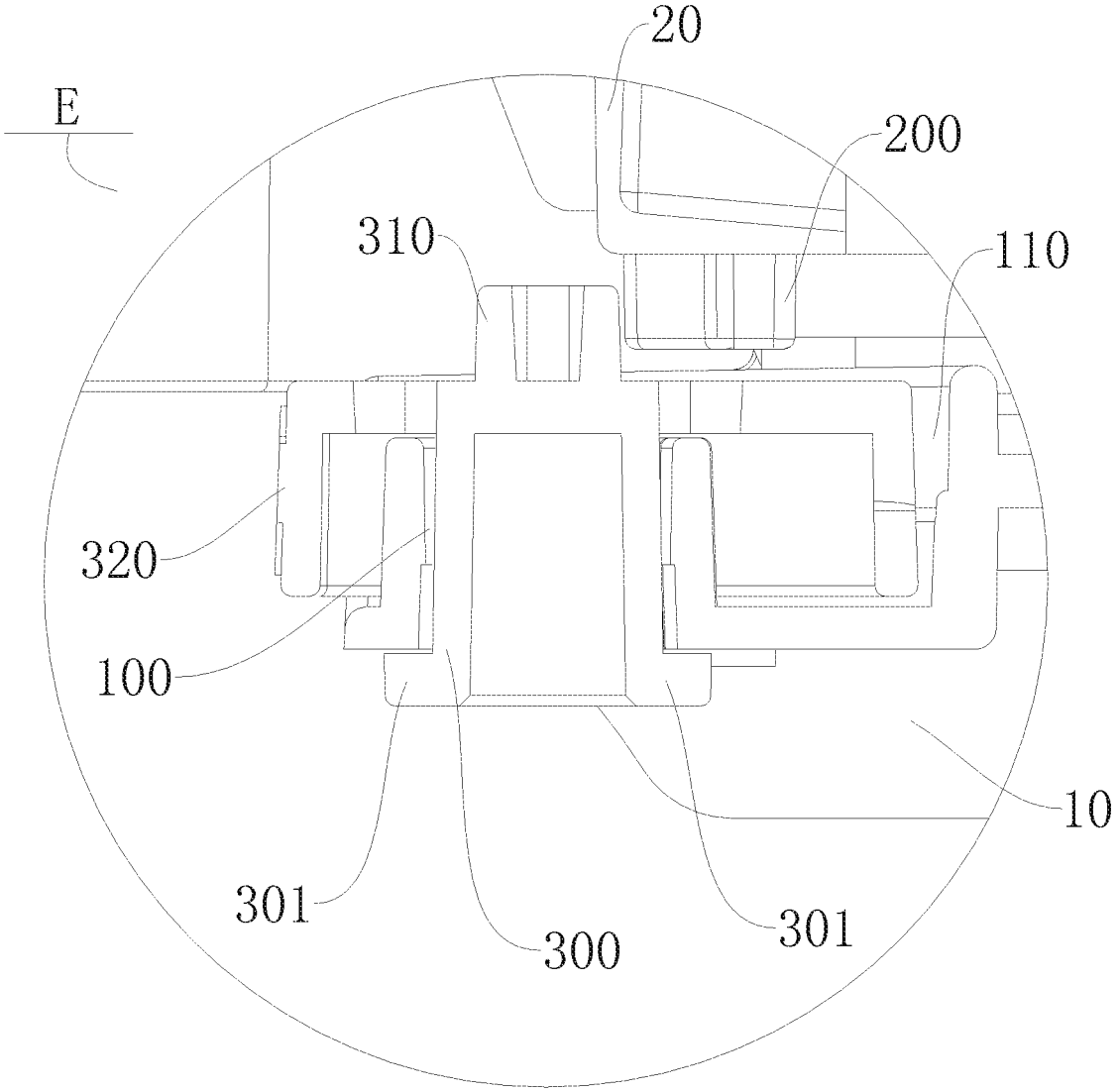
FIG. 14 is a structural enlarged view of a site E in FIG. 13.

As shown in FIGS. 1, 12 and 13, the water tank drawer 20 can be placed on the upper surface (the upper surface as shown in FIGS. 1,2,4, 12 and. 13) of the air outlet frame 10 of a purification air duct. Furthermore, the water tank drawer 20 is movable relative to the air outlet frame 10 of the purification air duct, and the relative positional relationship between the water tank drawer 20 and the air outlet frame 10 can be changed by pushing or pulling the water tank drawer 20.

As shown in FIG. 11, the safety locking member 30 includes a rotating shaft 300, a locking member 310 and a cooperation cover 320. The cooperation cover 320 is rotatably located in the cooperation groove 110, and covered and supported on the supporting column 120. The rotating shaft 300 passes through the supporting column 120 to cooperate with the cooperation hole 100. The outer peripheral wall of the cooperation cover 320 can include a first curved surface 321 and two planes 322, and the first curved surface 321 and the two planes 322 are connected at heads and tails to form a fan shape. A second curved surface 114 cooperating with the first curved surface 321 is arranged on the inner peripheral wall of the cooperation groove 110. The rotating shaft 300 is arranged on the cooperation cover 320, and the locking member 310 is arranged on the top wall of the cooperation cover 320. Two grooves 325 can be arranged on the top wall of the cooperation cover 320, and the two grooves 325 are located on both sides of the locking member 310. A handle projection 330 can be arranged at the intersection of the two planes 322. The handle projection 330 can be a bar-shaped member. One end of the handle projection 330 is connected with the outer peripheral wall of the cooperation cover 320, and the other end of the handle projection 330 can extend from the opening 1111 of the cooperation groove 110. The rotating shaft 300 can be a hollow member, the rotating shaft 300 can pass through the supporting column 120 and the cooperation hole 100, and the rotating shaft 300 is rotatable in the cooperation hole 100. Two cooperation protrusions 2 are arranged on the lower surface (the lower surface as shown in FIG. 7 and FIG. 12) of the water tank drawer 20, and a gap is provided between the two cooperation protrusions 200.

As shown in FIGS. 1,10 and 12, when the water tank drawer 20 is located on the air outlet frame 10 of the purification air duct (that is, the water tank drawer 20 is stacked on the air outlet frame 10, and the lower surface (the lower surface as shown in FIGS. 1,10 and. 12) of the water tank drawer 20 is opposite to the upper surface (the upper surface as shown in FIGS. 1,10 and 12) of the air outlet frame 10), the safety locking member 30 can cooperate with the two cooperation protrusions 200 on the lower surface (the lower surface as shown in FIG. 7 and FIG. 12) of the water tank drawer 20, so as to lock the water tank drawer 20 on the air outlet frame 10 or to unlock the water tank drawer 20 from the air outlet frame 10.

It should be noted that, "the water tank drawer 20 is locked on the air outlet frame 10 of a purification air duct" mentioned herein can indicate that the water tank drawer 20 is confined on the air outlet frame 10 of the purification air duct, that is, the water tank drawer 20 is static relative to the air outlet frame 10. "The water tank drawer 20 is unlocked from the air outlet frame 10 of a purification air duct" mentioned herein can indicate that the water tank drawer 20 is movable relative to the air outlet frame 10 of the purification air duct, and the water tank drawer 20 can be pulled to move the lower surface (the lower surface as shown in FIGS. 1,10 and 12) of the water tank drawer 20 away from the upper surface (the upper surface as shown in FIGS. 1,10 and 12) of the air outlet frame 10 of. FIG. 6 to FIG. 7 show views when the water tank drawer 20 is pulled out from the air outlet frame 10 of a purification air duct.

When the rotating shaft 300 is rotated to the locking position (that is, the position where the rotating shaft 300 is located in FIG. 4 to FIG. 5, the locking member 310 is located on the front sides (the front sides as shown in FIG. 9) of the two cooperation protrusions 200, and the length of the locking member 310 in the arrangement direction of the two cooperation protrusions 200 is greater than the gap between the two cooperation protrusions 200), the locking member 310 cannot pass through the space between the two cooperation protrusions 200. In other words, the water tank drawer 20 cannot be pulled out from the air outlet frame 10 of a purification air duct, so that the water tank drawer 20 can be confined on the air outlet frame 10 of the purification air duct. When the rotating shaft 300 is rotated to the movement-permitting position (that is, the position where the rotating shaft 300 is located in FIG. 2 to FIG. 3, the locking member 310 is located between the two cooperation protrusions 200, and the length of the locking member 310 in the arrangement direction of the two cooperation protrusions 200 is less than the gap between the two cooperation protrusions 200), the locking member 310 can pass through the space between the two cooperation protrusions 200. In other words, the water tank drawer 20 can be pulled out from the air outlet frame 10, and the water tank drawer 20 is movable relative to the air outlet frame 10.

A plurality of spaced apart positioning grooves 113 are formed in the inner peripheral wall of the cooperation groove 110, a plurality of elastic protrusions 323 are arranged on the outer peripheral wall of the cooperation cover 320, and at least one of the elastic protrusions 323 cooperates with one of the positioning grooves 113 at the movement-permitting position and the locking position. A notch 324 extending to the bottom wall of the cooperation cover 320 is formed in the outer peripheral wall of the cooperation cover 320, and the notches 324 are formed in both sides of each of the elastic protrusions 323. A dismounting port 130 communicating with the cooperation hole 100 is formed in the air outlet frame 10 of the purification air duct, an abutting projection 301 is arranged at a lower end of the rotating shaft 300, the abutting projection 301 and the dismounting port 130 are arranged to be staggered or offset to each other at the locking position and the movement-permitting position. When the rotating shaft 300 is rotated until the abutting projection 301 is aligned with the dismounting port 130, the rotating shaft 300 can be separated from the air outlet frame 10 of a purification air duct. Two dismounting ports 130 can be provided, and the two dismounting ports 130 are located on both ends of the radial direction of the cooperation hole 100.

In the air conditioner indoor unit of the embodiment of the present disclosure, by providing the safety locking member 30, the relative position between the locking member 310 and the two cooperation protrusions 200 on the water tank drawer 200 can be changed by rotating the rotating shaft 300, so that the positional relationship between the water tank drawer 20 and the air outlet frame 10 of the purification air duct can be switched. In other words, the water tank drawer 20 can be pulled out from the air outlet frame 10 of a purification air duct, and the water tank drawer 20 can also be limited on the air outlet frame 10 of a purification air duct, so as to prevent a child from accidentally pushing and pulling the water tank drawer 20 to cause an accident, so that the operational safety of the air treatment device 1 can be improved.

In the description of the present specification, the description with reference to the terms "one embodiment", "some embodiments", "illustrative embodiments", "examples", "specific examples", or "some examples" and the like mean that specific features, structures, materials or features described in combination with the embodiments or examples are included in at least one embodiment or example of the present disclosure. In the present specification, the schematic representation of the above terms does not necessarily mean the same embodiment or example. Furthermore, the specific features, structures, materials, or characteristics described can be combined in a suitable manner in any one or more embodiments or examples.

Although the embodiments of the present disclosure have been shown and described, those of ordinary skill in the art can understand that a lot of changes, modifications, substations and variations can be made to those embodiments of the present disclosure, without departing from the principles and purposes of the present disclosure, and the scope of the present disclosure is defined by the claims and their equivalents.

What is claimed is:

1. An air treatment device comprising:

an air outlet frame of a purification air duct, wherein the air outlet frame is provided with a ventilation hole and a cooperation hole;

a water tank drawer, wherein the water tank drawer is moveable on the air outlet frame and the water tank drawer comprises two spaced-apart cooperation protrusions on a bottom wall of the water tank drawer; and a safety lock, wherein the safety lock comprises a rotating shaft and a locking member, the rotating shaft is rotatable in the cooperation hole to switch the locking member between a locking position of the locking member and a movement-permitting position of the locking member, wherein:

at the locking position, the locking member engages the cooperation protrusions to prevent displacement of the cooperation protrusions with respect to the locking member, and at the movement-permitting position, the locking member is located between the two cooperation protrusions to avoid engagement with the cooperation protrusions, such that the displacement of the cooperation protrusions with respect to the locking member is allowed.

2. The air treatment device according to claim 1, wherein:

a dismounting port communicating with the cooperation hole is formed in the air outlet frame, an abutting projection is arranged at a lower end of the rotating shaft, the abutting projection and the dismounting port are arranged to be staggered to each other at the locking position and the movement-permitting position, and when the rotating shaft is rotated until the abutting projection is aligned with the dismounting port, the rotating shaft is separable from the air outlet frame.

3. An air conditioner indoor unit, comprising the air treatment device according to claim 1.

4. The air treatment device according to claim 1, wherein the air outlet frame comprises a cooperation groove, the cooperation hole is formed in a bottom wall of the cooperation groove, and the rotating shaft is arranged in the cooperation groove and rotatable in the cooperation hole.

5. The air treatment device according to claim 4, wherein the safety lock comprises a cooperation cover, the cooperation cover is rotatably located in the cooperation groove, a first curved surface is arranged on an outer peripheral wall of the cooperation cover, a second curved surface cooperating with the first curved surface is arranged on an inner peripheral wall of the cooperation cover, the rotating shaft is arranged on the cooperation cover, and the locking member is arranged on a top wall of the cooperation cover.

6. The air treatment device according to claim 5, further comprising a hollow supporting column, wherein the supporting column is arranged around the cooperation hole, the cooperation cover covers the supporting column and is supported on the supporting column, and the rotating shaft passes through the supporting column to cooperate with the cooperation hole.

7. The air treatment device according to claim 5, wherein two intersecting planes are arranged on the outer peripheral wall of the cooperation cover, and the two ends of the first curved surface are respectively connected with the two intersecting planes.

8. The air treatment device according to claim 7, wherein the safety lock further comprises a handle projection and the handle projection is arranged at an intersection of the two intersecting planes.

9. The air treatment device according to claim 5, wherein a plurality of spaced apart positioning grooves are formed in the inner peripheral wall of the cooperation groove, a plurality of elastic protrusions are arranged on the outer peripheral wall of the cooperation cover, and at least one of the elastic protrusions cooperates with one of the positioning grooves at the movement-permitting position and the locking position.

10. The air treatment device according to claim 9, wherein a notch extending to the bottom wall of the cooperation cover is formed in the outer peripheral wall of the cooperation cover, and a plurality of the notches are formed in both sides of each of the elastic protrusions.

* * * * *